US007294787B2

(12) United States Patent
Varkey

(10) Patent No.: US 7,294,787 B2
(45) **Date of Patent: *Nov. 13, 2007**

(54) ENHANCED ARMOR WIRES FOR WELLBORE CABLES

(75) Inventor: Joseph Varkey, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/469,612

(22) Filed: Sep. 1, 2006

(65) Prior Publication Data

US 2007/0102186 A1 May 10, 2007

Related U.S. Application Data

(63) Continuation-in-part of application No. 11/153,835, filed on Jun. 15, 2005, now Pat. No. 7,119,283.

(51) Int. Cl.
*H01B 7/18* (2006.01)

(52) U.S. Cl. ..... 174/102 R; 174/107; 174/108

(58) Field of Classification Search ..... 174/102 R, 174/102 C, 103, 106 R, 107, 108, 110 R, 174/110 S, 113 R, 116
See application file for complete search history.

(56) References Cited

U.S. PATENT DOCUMENTS 2,953,627 A * 9/1960 Malneritch et al. ..... 174/102 R
3,328,140 A * 6/1967 Warren ..... 428/602
3,602,632 A * 8/1971 Ollis ..... 174/36
3,773,109 A * 11/1973 Eberline ..... 340/855.1
3,784,732 A * 1/1974 Whitfill, Jr. ..... 174/108
4,275,786 A 6/1981 Lee
4,440,974 A * 4/1984 Naudet ..... 174/108
5,426,264 A * 6/1995 Livingston et al. ..... 174/102 R
5,495,547 A * 2/1996 Rafie et al. ..... 385/101
5,917,154 A * 6/1999 Mortier ..... 174/117 FF
6,060,662 A * 5/2000 Rafie et al. ..... 174/106 R
6,331,509 B1 * 12/2001 Heimann et al. ..... 508/136
6,600,108 B1 * 7/2003 Mydur et al. ..... 174/120 R

FOREIGN PATENT DOCUMENTS

GB 2321973 8/1998

* cited by examiner

*Primary Examiner*—William H. Mayo, III
(74) *Attorney, Agent, or Firm*—David Cate; Jaime Castano; Dale Gaudier

(57) ABSTRACT

Cables used with wellbore devices to analyze geologic formations adjacent a wellbore are disclosed. The cables include one or more armor wires formed of a high strength core surrounded by a corrosion resistant alloy clad. The cables may be employed as a slickline or multiline cables, where the armor wire is used to convey and suspend loads, such as tools, in a wellbore. The cables may also be useful for providing wellbore related mechanical services, such as, jamming, fishing, and the like.

20 Claims, 3 Drawing Sheets

ENHANCED ARMOR WIRES FOR WELLBORE CABLES

CROSS REFERENCE TO RELATED APPLICATION

This application is a Continuation-In-Part of and also claims the benefit of U.S. patent application Ser. No. 11/153,835, filed Jun. 15, 2005 now U.S. Pat. No. 7,119,283.

BACKGROUND OF THE INVENTION

This invention relates to wellbore cables, and methods of manufacturing and using such cables. In one aspect, the invention relates to cables with improved armor wires used with wellbore devices to analyze geologic formations adjacent a wellbore, methods of manufacturing same, as well as uses of such cables.

Generally, geologic formations within the earth that contain oil and/or petroleum gas have properties that may be linked with the ability of the formations to contain such products. For example, formations that contain oil or petroleum gas have higher electrical resistivity than those that contain water. Formations generally comprising sandstone or limestone may contain oil or petroleum gas. Formations generally comprising shale, which may also encapsulate oil-bearing formations, may have porosities much greater than that of sandstone or limestone, but, because the grain size of shale is very small, it may be very difficult to remove the oil or gas trapped therein. Accordingly, it may be desirable to measure various characteristics of the geologic formations adjacent to a well before completion to help in determining the location of an oil- and/or petroleum gas-bearing formation as well as the amount of oil and/or petroleum gas trapped within the formation.

Logging tools, which are generally long, pipe-shaped devices may be lowered into the well to measure such characteristics at different depths along the well. These logging tools may include gamma-ray emitters/receivers, caliper devices, resistivity-measuring devices, neutron emitters/receivers, and the like, which are used to sense characteristics of the formations adjacent the well. A wireline cable may be used to connect the logging tool with one or more electrical power sources and data analysis equipment at the earth's surface, as well as providing structural support to the logging tools as they are lowered and raised through the well. Generally, the wireline cable is spooled out of a truck, over a pulley, and down into the well.

Wireline cables are typically formed from a combination of metallic conductors, insulative material, filler materials, jackets, and/or metallic armor wires. When used, armor wires typically perform many functions in wireline cables, including protecting the electrical core from the mechanical abuse seen in typical downhole environment, and providing mechanical strength to the cable to carry the load of the tool string and the cable itself.

Armor wire performance is heavily dependent on corrosion protection. Harmful fluids in the downhole environment may cause armor wire corrosion, and once the armor wire begins to rust, strength and pliability may be quickly compromised. Although the cable core may still remain functional, it is not economically feasible to replace the armor wire(s), and the entire cable typically must be discarded.

Conventionally, wellbore cables utilize galvanized steel armor wires (typically plain carbon steels in the range AISI 1065 and 1085), known in the art as Galvanized Improved Plow Steel (GIPS) armor wires, which do provide high strength. Such armor wires are typically constructed of cold-drawn pearlitic steel coated with zinc for moderate corrosion protection. The GIPS armor wires are protected by a zinc hot-dip coating that acts as a sacrificial layer when the wires are exposed to moderate environments.

While zinc protects the steel at moderate conditions and temperatures, it is known that corrosion is readily possible at elevated temperatures and certain aggressive "sour well" downhole conditions. Hence, in such environments the typical useful life of a cable is limited, and the cable may be easily compromised. Also, hot dip galvanization results in a decreased steel strength and increases potential fracture origin sites, which may further contribute to corrosion related GIPS armor wire failure.

Further, during hot-dip galvanization an intermediate zinc-iron alloy layer forms between the steel and zinc. Because steel, zinc-iron alloys, and zinc all have different thermal expansion coefficients, this may lead to formation of cracks in the zinc-iron alloy layer during the post-hot-dip cooling process. These stress-relieving cracks are typically extended during the post-galvanization drawing process. The presence of such fractures during cable processing further decreases the corrosion resistance of cables using such armor wires. Zinc can also flake off during cable manufacturing, leading to significant accumulation of zinc dust in the manufacturing area.

Commonly, sour well cables constructed completely of corrosion resistant alloys are used in sour well downhole conditions. While such alloys are well suited for forming armor wires used in cables for such wells, it is commonly known that the strength of such alloys is very limited.

Thus, a need exists for cables and strength members that are high strength with improved corrosion and abrasion protection, while avoiding cracking and accumulation of zinc dust in the manufacturing environment. A cable or strength member that can overcome one or more of the problems detailed above while conducting larger amounts of power with significant data signal transmission capability, would be highly desirable, and the need is met at least in part by the following invention.

BRIEF SUMMARY OF THE INVENTION

In one aspect, the invention relates to wellbore cables with enhanced armor wires used with wellbore devices to analyze geologic formations adjacent a wellbore. Some cables may include at least one insulated conductor, and one or more armor wire layers surrounding the insulated conductor. On the other hand, some cables may not contain component used for electrical transmittance, but rather, serve as strength cables or members. The enhanced design of the armor wires used to form the armor wire layers include a high strength core surrounded by a corrosion resistant alloy clad (outer layer), such as a nickel based alloy, for example. A bonding layer may also be placed between the high strength core and corrosion resistant alloy clad. The cables may include a first armor wire layer surrounding the insulated conductor, and a second armor wire layer served around the first armor wire layer.

Some cables of the invention may be formed of one or more armor wires, and employed as a slickline or multiline cable, where the armor wire is used to convey and suspend loads, such as tools, in a wellbore. The cables may be useful for providing wellbore related mechanical services, such as, but not limited to, jamming, fishing, and the like. As above, the armor used is comprised of a high strength core surrounded by a corrosion resistant alloy clad. Also, a plurality of such armor wires may be bundles to form a strength member.

The cables of the invention may also be useful for a variety of applications including cables in subterranean operations, such as a monocable, a quadcable, a heptacable, slickline cable, multiline cable, a coaxial cable, or a seismic cable.

Any suitable material to form the high strength core may be used. Materials useful to form the corrosion resistant alloy clad of the armor wires include, by non-limiting example, such alloys as copper-nickel-tin based alloys, beryllium-copper based alloys, nickel-chromium based alloys, superaustenitic stainless steel alloys, nickel-cobalt based alloys and nickel-molybdenum-chromium based alloys, and the like, or any mixtures thereof.

Insulation materials used to form insulated conductors useful in cables of the invention is include, but are not necessarily limited to, polyolefins, polyaryletherether ketone, polyaryl ether ketone, polyphenylene sulfide, modified polyphenylene sulfide, polymers of ethylene-tetrafluoroethylene, polymers of poly(1,4-phenylene), polytetrafluoroethylene, perfluoroalkoxy polymers, fluorinated ethylene propylene, polytetrafluoroethylene-perfluoromethylvinylether polymers, polyamide, polyurethane, thermoplastic polyurethane, chlorinated ethylene propylene, ethylene chloro-trifluoroethylene, and any mixtures thereof.

In another aspect, the invention relates to methods for preparing cables which include forming the armor wires used to form the armor wire layers, providing at least one insulated conductor, serving a first layer of the armor wires around the insulated conductor, and serving a second layer of the same armor wires around the first layer of the armor wires. In one approach, the enhanced design of the armor wires are prepared by providing a high strength core, bringing the core strength member into contact with at least one sheets of a corrosion resistant alloy clad material, forming the sheet of alloy material around the high strength core, and drawing the combination of the alloy material and core strength member to a final diameter to form the enhanced design of the armor wire. Another approach to preparing the armor wires includes providing a high strength core, extruding an alloy material around the core, and drawing the combination of the alloy material and core strength member to a final diameter to form the armor wire. The preparation of armor wires may also include coating the high strength core with a bonding layer before forming the forming the alloy clad material around the high strength core.

BRIEF DESCRIPTION OF THE DRAWINGS

The invention may be understood by reference to the following description taken in conjunction with the accompanying drawings.

DETAILED DESCRIPTION OF THE INVENTION

Figure 1:
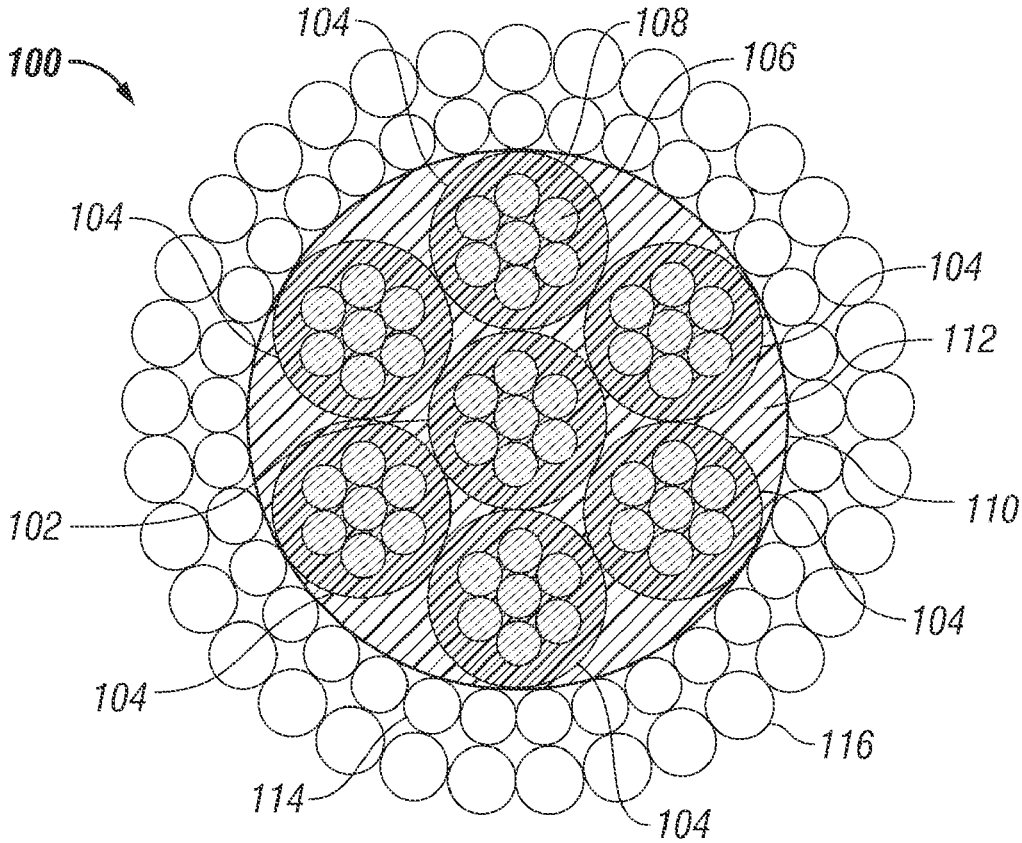
FIG. 1 (Prior Art)
FIG. 1 is a cross-sectional view of a typical prior art cable design.

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

The invention relates to cables and methods of manufacturing the same, as well as uses thereof. In one aspect, the invention relates to cables used with devices to analyze geologic formations adjacent a wellbore, methods of manufacturing the same, and uses of the cables in seismic and wellbore operations. While this invention and its claims are not bound by any particular mechanism of operation or theory, it has been discovered that using certain alloys to form an alloy clad upon a high strength core in preparing an armor wire, provides cables that have increased corrosion resistance, increased abrasion resistance, which possess high strength properties, while minimizing stress-relieving cracking/fracturing and zinc dust accumulation commonly encountered during cable manufacturing.

When cables of the invention are used for performing mechanical services, such as a mechanical slickline or multiline, incorporation of components intended to serve electrical conductors may or may not be required. Where electrical conductors are not necessary, the cables may serve as strength members having a single armor wire or a plurality of armor wires in stranded form.

Some cable embodiments of the invention generally include at least one insulated conductor, and at least one layer of high strength corrosion resistant armor wires surrounding the insulated conductor(s). Insulated conductors useful in the embodiments of the invention include metallic conductors, or even one or more optical fibers. Such conductors or optical fibers may be encased in an insulated jacket. Any suitable metallic conductors may be used. Examples of metallic conductors include, but are not necessarily limited to, copper, nickel coated copper, or aluminum. Preferred metallic conductors are copper conductors. While any suitable number of metallic conductors may be used in forming the insulated conductor, preferably from 1 to about 60 metallic conductors are used, more preferably 7, 19, or 37 metallic conductors. Components, such as conductors, armor wires, filler, optical fibers, and the like, used in cables according to the invention may be positioned at zero helix angle or any suitable helix angle relative to the center axis of the cable. Generally, a central insulated conductor is positioned at zero helix angle, while those components a surrounding the central insulated conductor are helically positioned around the central insulated conductor at desired helix angles. A pair of layered armor wire layers may be contra-helically wound, or positioned at opposite helix angles.

Insulating materials useful to form the insulation for the conductors and insulated jackets may be any suitable insulating materials known in the art. Non-limiting examples of insulating materials include polyolefins, polytetrafluoroethylene-perfluoromethylvinylether polymer (MFA), perfluoroalkoxyalkane polymer (PFA), polytetrafluoroethylene polymers (PTFE), ethylene-tetrafluoroethylene polymers (ETFE), ethylene-propylene copolymers (EPC), poly(4-methyl-1-pentene) (TPX® available from Mitsui Chemicals, Inc.), other fluoropolymers, polyaryletherether ketone polymers (PEEK), polyphenylene sulfide polymers (PPS), modified polyphenylene sulfide polymers, polyether ketone polymers (PEK), maleic anhydride modified polymers, perfluoroalkoxy polymers, fluorinated ethylene propylene polymers, polytetrafluoroethylene-perfluoromethylvinylether polymers, polyamide polymers, polyurethane, thermoplastic polyurethane, ethylene chloro-trifluoroethylene polymers (such as Halar®), chlorinated ethylene propylene polymers, Parmax® SRP polymers (self-reinforcing polymers manufactured by Mississippi Polymer Technologies, Inc based on a substituted poly (1,4-phenylene) structure where each phenylene ring has a substituent R group derived from a wide variety of organic groups), or the like, and any mixtures thereof.

In some embodiments of the invention, the insulated conductors are stacked dielectric insulated conductors, with electric field suppressing characteristics, such as those used in the cables described in U.S. Pat. No. 6,600,108 (Mydur, et al.). Such stacked dielectric insulated conductors generally include a first insulating jacket layer disposed around the metallic conductors wherein the first insulating jacket layer has a first relative permittivity, and, a second insulating jacket layer disposed around the first insulating jacket layer and having a second relative permittivity that is less than the first relative permittivity. The first relative permittivity is within a range of about 2.5 to about 10.0, and the second relative permittivity is within a range of about 1.8 to about 5.0.

Cables according to the invention may be of any practical design. The cables may be wellbore cables, including monocables, coaxial cables, quadcables, heptacables, seismic cables, slickline cables, multi-line cables, and the like. In coaxial cable designs of the invention, a plurality of metallic conductors surround the insulated conductor, and are positioned about the same axis as the insulated conductor. Also, for any cables of the invention, the insulated conductors may further be encased in a tape. All materials, including the tape disposed around the insulated conductors, may be selected so that they will bond chemically and/or mechanically with each other. Cables of the invention may have an outer diameter from about 0.5 mm to about 400 mm, preferably, a diameter from about 1 mm to about 100 mm, more preferably from about 2 mm to about 15 mm.

Referring to slicklines and multilines, these may be categorized as electrical or mechanical cables which are used in wellbores which may be producing. The electrical cables typically have an electrical core, and have the capacity to convey lightweight tools through the wellbore. The mechanical cables are useful in a variety of mechanical services, such as jarring, manipulating a downhole valve or other device, setting plugs, making connections, disconnecting component, and the like.

Referring now to FIG. 1, a cross-sectional view of a common cable design. FIG. 1 depicts a cross-section of a typical armored cable design used for downhole applications. The cable 100 includes a central conductor bundle 102 having multiple conductors and an outer polymeric insulating material. The cable 100 further includes a plurality of outer conductor bundles 104, each having several metallic conductors 106 (only one indicated), and a polymeric insulating material 108 surrounding the outer metallic conductors 106. Preferably, the metallic conductor 106 may be a copper conductor. The central conductor bundle 102 of a typical prior art cables, although need not be, is typically the same design as the outer conductor bundles 104. An optional tape and/or tape jacket 110 made of a material that may be either electrically conductive or electrically non-conductive and that is capable of withstanding high temperatures encircles the outer conductor bundles 104. The volume within the tape and/or tape jacket 110 not taken by the central conductor bundle 102 and the outer conductors 104 is filled with a filler 112, which may be made of either an electrically conductive or an electrically non-conductive material. A first armor layer 114 and a second armor layer 116, generally made of a high tensile strength galvanized improved plow steel (GIPS) armor wires, surround and protect the tape and/or tape jacket 110, the filler 112, the outer conductor bundles 104, and the central conductor bundle 102.

Armor wires useful for cable embodiments of the invention, have bright, drawn high strength steel wires (of appropriate carbon content and strength for wireline use) placed at the core of the armor wires. An alloy with resistance to corrosion is then clad over the core. The corrosion resistant alloy layer may be clad over the high strength core by extrusion or by forming over the steel wire. The corrosion resistant clad may be from about 50 microns to about 600 microns in thickness. The material used for the corrosion resistant clad may be any suitable alloy that provides sufficient corrosion resistance and abrasion resistance when used as a clad. The alloys used to form the clad may also have tribological properties adequate to improve the abrasion resistance and lubricating of interacting surfaces in relative motion, or improved corrosion resistant properties that minimize gradual wearing by chemical action, or even both properties.

While any suitable alloy may be used as a corrosion resistant alloy clad to form the armor wires according to the invention, some examples include, but are not necessarily limited to: beryllium-copper based alloys; nickel-chromium based alloys (such as Inconel® available from Reade Advanced Materials, Providence, R.I. USA 02915-0039); superaustenitic stainless steel alloys (such as 20Mo6® of Carpenter Technology Corp., Wyomissing, Pa. 19610-1339 U.S.A., INCOLOY® alloy 27-7MO and INCOLOY® alloy 25-6MO from Special Metals Corporation of New Hartford, N.Y., U.S.A., or Sandvik 13RM19 from Sandvik Materials Technology of Clarks Summit, Pa. 18411, U.S.A.); nickel-cobalt based alloys (such as MP35N from Alloy Wire International, Warwick, R.I., 02886 U.S.A.); copper-nickel-tin based alloys (such as ToughMet® available from Brush Wellman, Fairfield, N.J., USA); or, nickel-molybdenum-chromium based alloys (such as HASTELLOY® C276 from Alloy Wire International). The corrosion resistant alloy clad may also be an alloy comprising nickel in an amount from about 10% to about 60% by weight of total alloy weight, chromium in an amount from about 15% to about 30% by weight of total alloy weight, molybdenum in an amount from about 2% to about 20% by weight of total alloy weight, cobalt in an amount up to about 50% by weight of total alloy weight, as well as relatively minor amounts of other elements such as carbon, nitrogen, titanium, vanadium, or even iron. The preferred alloys are nickel-chromium based alloys, and nickel-cobalt based alloys.

Some cables according to the invention include at least one layer of armor wires surrounding the insulated conductor. The armor wires used in cables of the invention, comprising a high strength core and a corrosion resistant alloy clad may be used alone, or may be combined with other types armor wires, such as galvanized improved plow steel wires, to form the armor wire layers. Two layers of armor wires can be used to form some cables of the invention.

Figure 2:
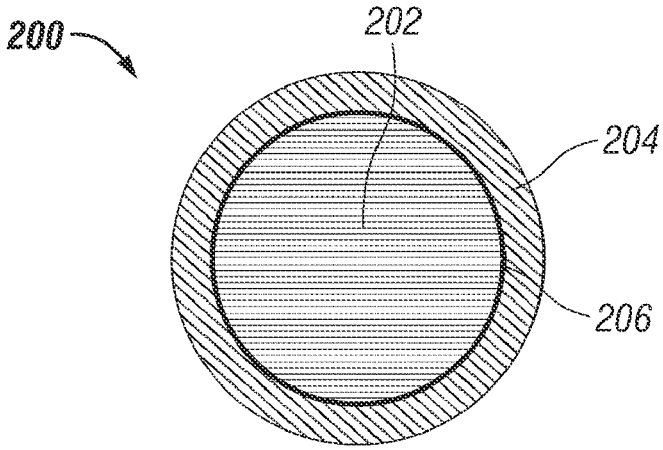
FIG. 2 is a stylized cross-sectional representation of an armor wire design useful for some cables of the invention.

FIG. 2 is a stylized cross-sectional representation of an enhanced design of the armor wire useful in some cables of the invention. The armor wire 200 includes a high strength core 202, surrounded by a corrosion resistant alloy clad 206. An optional bonding layer 204 may be placed between the core 202 and alloy clad 206. The core 202 may be generally made of any high tensile strength material such as, by non-limiting example, steel. Examples of suitable steels which may be used as core strength members include, but are not necessarily limited to AISI (American Iron and Steel Institute) 1070, AISI 1086, or AISI 1095 steel grades, tire cords, any high strength steel wires with strength greater than 2900 mPa, and the like. The core strength member 202 can include steel core for high strength, or even plated or coated wires. When used, the bonding layer 204 may be any material useful in promoting a strong bond between the high strength core 202 and corrosion resistant alloy clad 206. Preferably, when used, a layer of brass may be applied through a hot-dip or electrolytic deposition process to form the bonding layer 204.

Armor wire 200 may be used as an element in an armor wire layer or plurality of layers, grouped together to form a bundle of armor wires, or even used individually. When used individually, armor wire 200 may be useful as a slickline cable where electrical and data conductivity is optional, not required, nor critical. While armor wire 200 may be of any suitable diameter, as a slickline, the preferred diameter is from about 1 mm to about 10 mm, more preferably from about 1 mm to about 6 mm. Slickline cables based upon armor wire 200 have the advantages of increased strength, reduced stretching, and improved corrosion resistance, as compared with other cables used in the field. Armor wire 200 may also serve as a cable for applications other than wellbore use, such as those applications where suspension and/or transport of a load is required, electrical and/or data transmittance applications, or any other suitable cable application.

Figure 3:
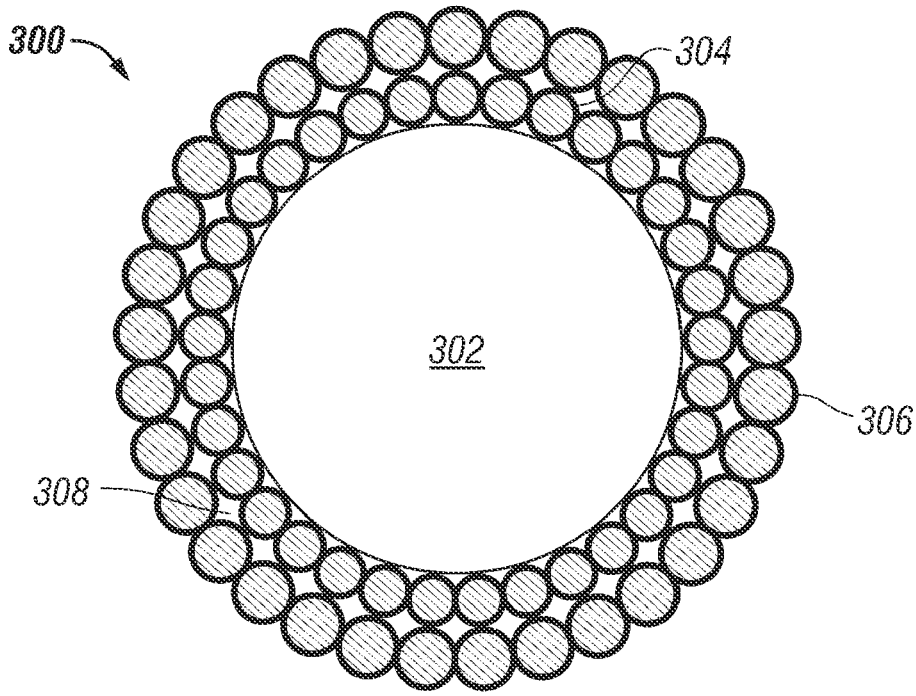
FIG. 3 is a cross-sectional representation of a general cable design according to the invention using two layers of armor wires

Referring now to FIG. 3, a cross-sectional representation of some cable designs according to the invention which incorporates two layers of armor wires. The cable 300 includes at least one insulated conductor 302 and two layers of armor wires, 304 and 306. The armor wire layers, 304 and 306, surrounding the insulated conductor(s) 302 include armor wires, such as armor wire 200 in FIG. 2, comprising a high strength core and a corrosion resistant alloy clad. Optionally, in the interstitial spaces 308, formed between armor wires, as well as formed between armor wires and insulated conductor(s) 302, a polymeric material may be disposed.

Polymeric materials disposed in the interstitial spaces 308 may be any suitable material. Some useful polymeric materials include, by nonlimiting example, polyolefins (such as EPC or polypropylene), other polyolefins, polyaryletheretherketone (PEEK), polyaryl ether ketone (PEK), polyphenylene sulfide (PPS), modified polyphenylene sulfide, polymers of ethylene-tetrafluoroethylene (ETFE), polymers of poly(1,4-phenylene), polytetrafluoroethylene (PTFE), perfluoroalkoxy (PFA) polymers, fluorinated ethylene propylene (FEP) polymers, polytetrafluoroethylene-perfluoromethylvinylether (MFA) polymers, Parmax®, and any mixtures thereof. Preferred polymeric materials are ethylene-tetrafluoroethylene polymers, perfluoroalkoxy polymers, fluorinated ethylene propylene polymers, and polytetrafluoroethylene-perfluoromethylvinylether polymers. The polymeric materials may be disposed contiguously from the insulated conductor to the outermost layer of armor wires, or may even extend beyond the outer periphery thus forming a polymeric jacket that completely encases the armor wires.

A protective polymeric coating may be applied to strands of armor wire for additional protection, or even to promote bonding between the armor wire and the polymeric material disposed in the interstitial spaces. As used herein, the term bonding is meant to include chemical bonding, mechanical bonding, or any combination thereof. Examples of coating materials which may be used include, but are not necessarily limited to, fluoropolymers, fluorinated ethylene propylene (FEP) polymers, ethylene-tetrafluoroethylene polymers (Tefzel®), perfluoro-alkoxyalkane polymer (PFA), polytetrafluoroethylene polymer (PTFE), polytetrafluoroethylene-perfluoromethylvinylether polymer (MFA), polyaryletheretherketone polymer (PEEK), or polyether ketone polymer (PEK) with fluoropolymer combination, polyphenylene sulfide polymer (PPS), PPS and PTFE combination, latex or rubber coatings, and the like. Each armor wire may also be plated with materials for corrosion protection or even to promote bonding between the armor wire and polymeric material. Nonlimiting examples of suitable plating materials include copper alloys, and the like. Plated armor wires may even cords such as tire cords. While any effective thickness of plating or coating material may be used, a thickness from about 10 microns to about 100 microns is preferred.

Figure 4:
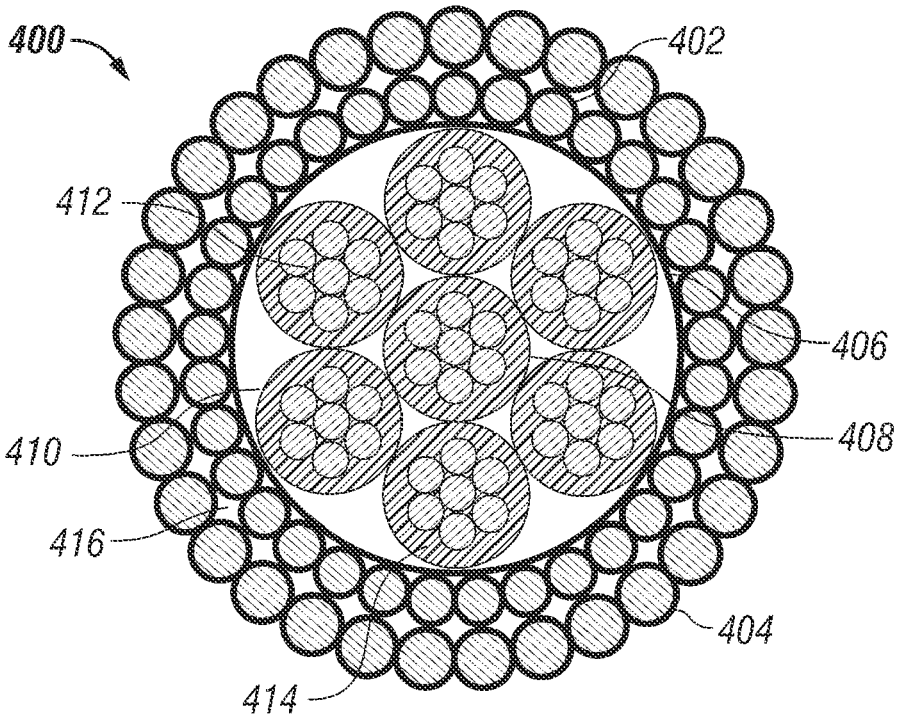
FIG. 4 is a cross-sectional representation of a heptacable design according to the invention, including two layers of armor wires.

FIG. 4 is a cross-sectional representation of a heptacable design according to the invention, including two layers of armor wires. The cable 400 includes two layers of armor wires, 402 and 404, surrounding a tape and/or tape jacket 406. The armor wire layers, 402 and 404, include armor wires, such as armor wire 200 in FIG. 2, comprising a high strength core and a corrosion resistant alloy clad. The interstitial space within the tape and/or tape jacket 406 comprises a central insulated conductor 408 and six outer insulated conductors 410 (only one indicated). The interstitial space within the tape and/or tape jacket 406, not occupied by the central insulated conductor 408 and six outer insulated conductors 410 may be filled with a suitable filler material, which may be made of either an electrically conductive or an electrically non-conductive material. The central insulated conductor 408 and six outer insulated conductors 410, each have a plurality of conductors 412 (only one indicated), and insulating material 414 surrounding the conductors 412. Preferably, the conductor 412 is a copper conductor. Optionally, a polymeric material may be disposed in the interstitial spaces 416, formed between armor wires, as well as formed between armor wires and tape jacket 406.

Figure 5:
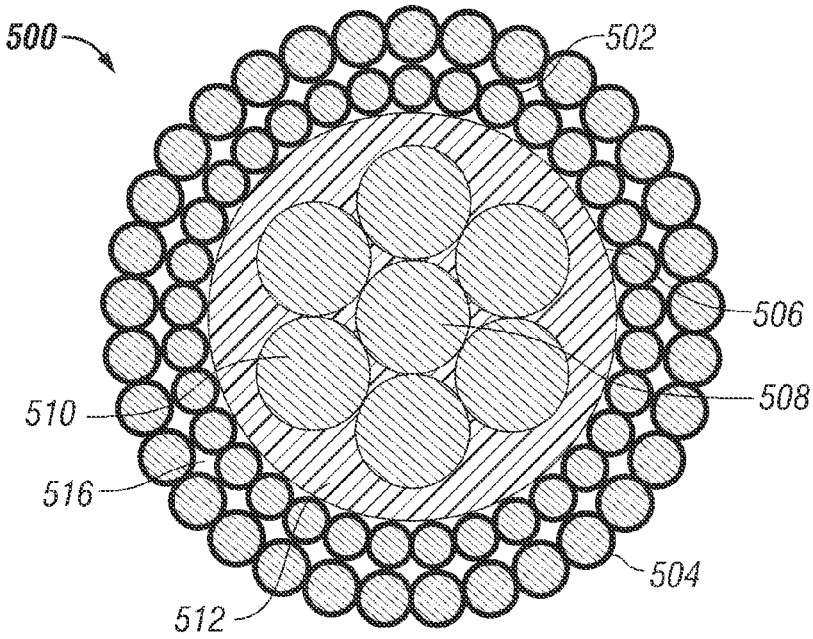
FIG. 5 represents, by stylized cross-section, a monocable design according to the invention.

FIG. 5 represents, by stylized cross-section, a monocable design according to the invention. The cable 500 includes two layers of armor wires, 502 and 504, surrounding a tape and/or tape jacket 506. The armor wire layers, 502 and 504, include armor wires, such as armor wire 200 in FIG. 2, comprising a high strength core and a corrosion resistant alloy clad. The central conductor 508 and six outer conductors 510 (only one indicated) are surrounded by tape jacket 506 and layers of armor wires 502 and 504. Preferably, the conductors 508 and 510 are copper conductors. The interstitial space formed between the tape jacket 506 and six outer conductors 510, as well as interstitial spaces formed between the six outer conductors 510 and central conductor 508 the may be filled with an insulating material 512 to form an insulated conductor. Optionally, a polymeric material may be disposed in the interstitial spaces 516, formed between armor wires, as well as formed between armor wires and tape jacket 506.

Figure 6:
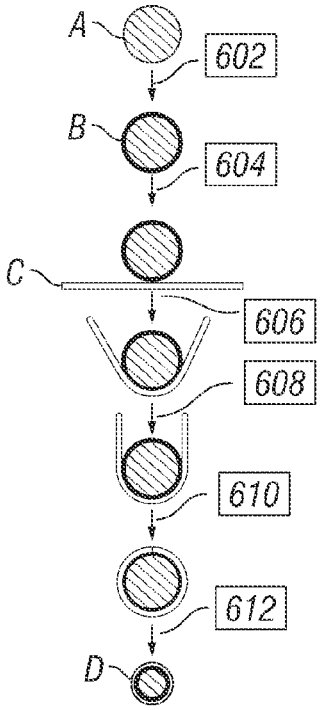
FIG. 6 illustrates a method of preparing armor wires useful in cables according to the invention.

FIG. 6 illustrates a method of preparing some armor wires according to the invention. Accordingly, a high strength core A is provided. At point 602, the core A may optionally be coated with a bonding layer B, such as brass using a hot dip or electrolytic deposition process. At point 604 the optional bonding layer coated core A is brought into contact with a sheet of corrosion resistant alloy material C, such as, by nonlimiting example, Inconel® nickel-chromium based alloy. The alloy material C is used to prepare the corrosion resistant alloy clad. At points 606, 608, and 610, the alloy material is formed around the optional bonding layer core A, using, for example, rollers. Such forming of the alloy material is done at temperatures between ambient temperature and about 850° C. Additionally, the optional bonding layer B may flow and to sufficiently provide a slipping interface between the high strength core A and the corrosion resistant alloy clad comprised of alloy material C. At point 612, the wire is drawn down to final diameter to form the armor wire D. The drawn thicknesses of the optional bonding layer coated core A alloy clad C may be proportional to the pre-drawn thickness.

Figure 7:
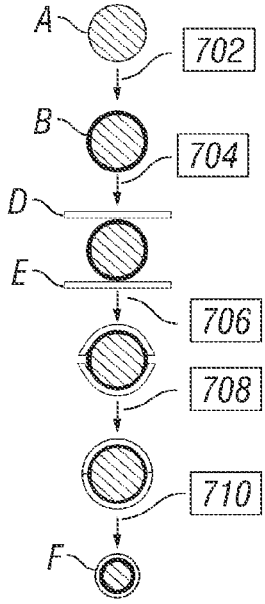
FIG. 7 illustrates another method of preparing some armor wires useful in cables according to the invention.

FIG. 7 illustrates another method of preparing armor wires. According to this next method, a high strength core A is provided, and at point 702, the high strength core A is optionally coated with a bonding layer B. At point 704 the optional bonding layer coated core A is brought into contact with two separate sheets of corrosion resistant alloy material, D and E, to form the corrosion resistant alloy clad. At points 706 and 708, the sheets of alloy material are formed around the optional bonding layer coated core A. At point 710, the wire is drawn down to final diameter to form the armor wire F.

Figure 8:
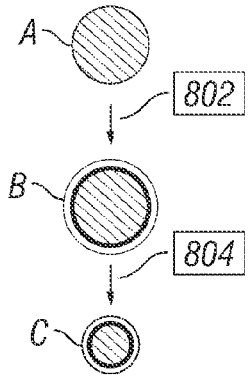
FIG. 8 illustrates yet another method of preparing some armor wires.

FIG. 8 illustrates yet another method of preparing armor wires, an extrusion and drawing method. Accordingly, a high strength core A is provided, and at point 802, and corrosion resistant alloy clad B is extruded over core A. The material forming the corrosion resistant alloy clad B may be hot or cold extruded onto the core A. At 804, the wire is drawn down to final diameter to form the armor wire C. Further, the high strength core A may be optionally coated with a bonding layer prior to extruding the corrosion resistant alloy clad B.

The materials forming the insulating layers and the polymeric materials used in the cables according to the invention may further include a fluoropolymer additive, or fluoropolymer additives, in the material admixture to form the cable. Such additive(s) may be useful to produce long cable lengths of high quality at high manufacturing speeds. Suitable fluoropolymer additives include, but are not necessarily limited to, polytetrafluoroethylene, perfluoroalkoxy polymer, ethylene tetrafluoroethylene copolymer, fluorinated ethylene propylene, perfluorinated poly(ethylene-propylene), and any mixture thereof. The fluoropolymers may also be copolymers of tetrafluoroethylene and ethylene and optionally a third comonomer, copolymers of tetrafluoroethylene and vinylidene fluoride and optionally a third comonomer, copolymers of chlorotrifluoroethylene and ethylene and optionally a third comonomer, copolymers of hexafluoropropylene and ethylene and optionally third comonomer, and copolymers of hexafluoropropylene and vinylidene fluoride and optionally a third comonomer. The fluoropolymer additive should have a melting peak temperature below the extrusion processing temperature, and preferably in the range from about 200° C. to about 350° C. To prepare the admixture, the fluoropolymer additive is mixed with the insulating jacket or polymeric material. The fluoropolymer additive may be incorporated into the admixture in the amount of about 5% or less by weight based upon total weight of admixture, preferably about 1% by weight based or less based upon total weight of admixture, more preferably about 0.75% or less based upon total weight of admixture.

Cables of the invention may include armor wires employed as electrical current return wires which provide paths to ground for downhole equipment or tools. The invention enables the use of armor wires for current return while minimizing electric shock hazard. In some embodiments, a polymeric material isolates at least one armor wire in the first layer of armor wires thus enabling their use as electric current return wires.

The present invention is not limited, however, to cables having only metallic conductors. Optical fibers may be used in order to transmit optical data signals to and from the device or devices attached thereto, which may result in higher transmission speeds, lower data loss, and higher bandwidth.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

What is claimed is:

1. A cable comprising one or more armor wires, wherein the armor wire(s) comprises a high strength core and a corrosion resistant alloy clad, and wherein the corrosion resistant alloy forms the outer layer of the armor wire(s).

2. A cable according to claim 1 where a bonding layer is placed between the high strength core and corrosion resistant alloy clad.

3. A cable according to claim 2 wherein the bonding layer comprises brass.

4. A cable according to claim 1 wherein the high strength core is steel and the corrosion resistant alloy clad is an alloy comprising nickel in an amount from about 10% to about 60% by weight of total alloy weight, chromium in an amount from about 15% to about 30% by weight of total alloy weight, molybdenum in an amount from about 2% to about 20% by weight of total alloy weight, and cobalt in an amount up to about 50% by weight of total alloy weight.

5. A cable according to claim 1 wherein the corrosion resistant alloy clad comprises an alloy selected from the group consisting of beryllium-copper based alloys, copper-nickel-tin based alloys, superaustenitic stainless steel alloys, nickel-cobalt based alloys, nickel-chromium based alloys, nickel-molybdenum-chromium based alloys, and any mixtures thereof.

6. A cable according to claim 1 wherein the corrosion resistant alloy clad comprises a nickel-chromium based alloy or a nickel-cobalt based alloy.

7. A cable according to claim 1 wherein the high strength core is steel of strength greater than about 2900 mPa and the corrosion resistant alloy clad comprises a nickel-chromium based alloy.

8. A cable according to claim 1 which has an outer diameter from about 0.5 mm to about 400 mm.

9. A cable according to claim 8 which has an outer diameter from about 1 mm to about 10 mm.

10. A cable according to claim 9 which has an outer diameter from about 1 mm to about 6 mm.

11. A cable according to claim 1 wherein the cable is a slickline cable.

12. A cable according to claim 11 wherein the cable comprises one armor wire.

13. A cable according to claim 1 wherein the corrosion resistant alloy clad is extruded over the high strength core, and the clad and core are drawn to prepare the armor wires.

14. A cable according to claim 1 wherein the corrosion resistant alloy clad is at least one sheet of corrosion resistant alloy formed over the high strength core, and the clad and core are drawn to prepare the armor wires.

15. A wellbore cable comprising armor wires, wherein the armor wire comprises a high strength core and a corrosion resistant alloy clad, and wherein the corrosion resistant alloy forms the outer layer of the armor wire.

16. A cable according to claim 15 which has an outer diameter from about 1 mm to about 10 mm.

17. A cable according to claim 16 which has an outer diameter from about 1 mm to about 6 mm.

18. A cable according to claim 15 wherein the corrosion resistant alloy clad is extruded over the high strength core, and the clad and core are drawn to prepare the armor wires.

19. A cable according to claim 15 wherein the corrosion resistant alloy clad is at least one sheet of corrosion resistant alloy formed over the high strength core, and the clad and core are drawn to prepare the armor wires.

20. A cable according to claim 15 wherein the cable is a slickline cable.

* * * * *